US009360251B2

(12) United States Patent
Dubettier-Grenier et al.

(10) Patent No.: US 9,360,251 B2
(45) Date of Patent: Jun. 7, 2016

(54) METHOD AND INTEGRATED DEVICE FOR SEPARATING AIR AND HEATING AN AIR GAS ORIGINATING FROM AN AIR SEPARATION DEVICE

(75) Inventors: Richard Dubettier-Grenier, La Varenne Saint Hilaire (FR); Jean-Pierre Tranier, L'Hay-les-Roses (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 713 days.

(21) Appl. No.: 13/583,486

(22) PCT Filed: Mar. 3, 2011

(86) PCT No.: PCT/FR2011/050445

§ 371 (c)(1),
(2), (4) Date: Sep. 7, 2012

(87) PCT Pub. No.: WO2011/110775

PCT Pub. Date: Sep. 15, 2011

(65) Prior Publication Data

US 2012/0324944 A1 Dec. 27, 2012

(30) Foreign Application Priority Data

Mar. 9, 2010 (FR) ..... 10 51676

(51) Int. Cl.
*F25J 3/00* (2006.01)
*F25J 3/04* (2006.01)

(52) U.S. Cl.
CPC ..... *F25J 3/04533* (2013.01); *F25J 3/04018* (2013.01); *F25J 3/04066* (2013.01);

(Continued)

(58) Field of Classification Search
CPC . F25J 3/04533; F25J 3/04612; F25J 3/04018; F25J 3/04157; F25J 3/04521; F25J 2260/02; F25J 2205/70; F25J 3/04618; F25J 3/04181; F25J 3/04066; F25J 3/04545
See application file for complete search history.

(56) References Cited

U.S. PATENT DOCUMENTS 5,656,557 A 8/1997 Hata et al.
5,724,805 A 3/1998 Golomb et al.

(Continued)

FOREIGN PATENT DOCUMENTS

FR 2 858 398 2/2005
JP 59 131 821 7/1984

(Continued)

OTHER PUBLICATIONS

Anonymous, "Use of heat recovered from intercooled air compressor to pre-heat boiler feed water," IP.com Journal, Sep. 17, 2008.

(Continued)

*Primary Examiner* — Keith Raymond
(74) *Attorney, Agent, or Firm* — Justin K. Murray

(57) ABSTRACT

The invention relates to an integrated device for separating air and heating a gas in the air resulting from said air separation, comprising: an air separation device (9); a heat exchanger (13, 43); a channel for conveying the gas in the air to the heat exchanger; and a channel for conveying water to the heat exchanger, the water-conveying channel being connected to the water inlet or water outlet of a water preheat exchanger (5) or a water deaerator (27). According to the invention, the preheat exchanger and/or the deaerator are connected to an oxy-combustion boiler (19) in order to convey water to and from the boiler, said boiler also being connected to the separation device in order to receive an oxygen-enriched gas (17).

14 Claims, 3 Drawing Sheets

(52) U.S. Cl.
CPC ..... *F25J3/04157* (2013.01); *F25J 3/04181* (2013.01); *F25J 3/04521* (2013.01); *F25J 3/04545* (2013.01); *F25J 3/04612* (2013.01); *F25J 3/04618* (2013.01); *F25J 2205/70* (2013.01); *F25J 2210/06* (2013.01); *F25J 2230/06* (2013.01); *F25J 2240/70* (2013.01); *F25J 2260/02* (2013.01)

(56) References Cited

U.S. PATENT DOCUMENTS

| | | | | |
|---|---|---|---|---|
| 5,921,106 | A | 7/1999 | Girault et al. | |
| 6,282,901 | B1 | 9/2001 | Marin et al. | |
| 7,565,806 | B2 * | 7/2009 | Saulnier | F02C 3/30 60/39.182 |
| 2004/0016237 | A1 | 1/2004 | Marin et al. | |
| 2006/0137393 | A1 * | 6/2006 | Bot | 62/644 |
| 2010/0132360 | A1 * | 6/2010 | Gericke | 60/653 |
| 2010/0170285 | A1 * | 7/2010 | Wallace et al. | 62/401 |
| 2011/0061385 | A1 * | 3/2011 | Baxter | 60/649 |

FOREIGN PATENT DOCUMENTS

| | | |
|---|---|---|
| JP | 06 304 432 | 11/1994 |
| JP | 11 173 753 | 7/1999 |
| JP | 2004 150 685 | 5/2004 |
| JP | 2004 257 721 | 9/2004 |
| JP | 2007 205 188 | 8/2007 |
| JP | 2008 545 945 | 12/2008 |
| WO | WO 2010 052437 | 5/2010 |

OTHER PUBLICATIONS

International Search Report and Written Opinion for PCT/FR2011/050445, mailed May 27, 2015.

* cited by examiner

METHOD AND INTEGRATED DEVICE FOR SEPARATING AIR AND HEATING AN AIR GAS ORIGINATING FROM AN AIR SEPARATION DEVICE

CROSS REFERENCE TO RELATED APPLICATIONS

This application is a §371 of International PCT Application PCT/FR2010/052368, filed Nov. 4, 2010, which claims priority to France Patent Application no. 0958305, filed Nov. 24, 2009, the entire contents of which are incorporated herein by reference.

TECHNICAL FIELD OF THE INVENTION

The present invention relates to a method and an integrated device for separating air and heating an air gas originating from an air separation device.

BACKGROUND

It is frequently necessary to heat one of the gaseous products of an air separation device to a temperature of use. In particular, it is known:

- to use an electric or steam heater to heat the residual nitrogen from a cold box to regenerate the adsorbents of an air purification unit upstream of the cold box;
- to preheat the oxygen injected into an oxycombustion boiler with flue gases.

Using electricity to heat a fluid amounts to wasting "noble" energy because the efficiency of conversion between thermal energy and electrical energy does not exceed 50% at best.

In a power station, bleeding steam from the steam cycle can lead to significant electricity production losses.

From a thermodynamic point of view, in FIG. 1, it is seen that the exchange diagram representing the exchange of heat E on the abscissa axis and the temperature T on the ordinate axis for heating residual nitrogen WN2 with steam V is pinched at the hot end, but has a high ΔT at the cold end. Even recovering heat from the condensates of the steam (there would then be a lower ΔT at the cold end), the exchange diagram would remain overall very spread out (i.e. the area between the curves remains very large, which signifies high entropic loss).

In an "oxycombustion" type power station, for preheating oxygen sent to the oxycombustion process:

- the flue gases from the boiler may be used;
- the overall efficiency of the installation may be improved by recovering heat at the outlet of the compressors of the air separation device.

In the latter case, a gas/gas (air/$O_2$) exchanger may be used, but this is a very large piece of equipment that necessitates a large exchange area, whilst having a very low head loss.

SUMMARY OF THE INVENTION

An object of the invention is to find means of heating at low cost and at substantially constant temperature enabling efficient exchange of heat for heating an air gas.

According to one feature of the invention, there is provided an integrated device for separating air and heating an air gas resulting from the air separation, comprising an air separation device, a heat exchanger, a pipe for conveying the gas in the air to the heat exchanger, and a pipe for conveying water thereto, the pipe for conveying water being connected to the water inlet or water outlet of a water preheating exchanger or a water de-aerator, the preheating exchanger and/or the de-aerator being connected to an oxycombustion boiler in order to convey water thereto and to receive water from the boiler, the boiler also being connected to the separation device in order to receive an oxygen-enriched gas.

According to optional other features:

- the pipe sending water to the heat exchanger is connected to the preheated water outlet of the water preheating exchanger or to the de-aerated water outlet of the water de-aerator;
- the air gas is the gas enriched with oxygen and a pipe connects the heat exchanger to the boiler to send thereto the heated gas enriched with oxygen;
- there is a pipe connecting the heat exchanger with the inlet for water to be preheated of the preheating exchanger for sending water that has been used to heat the air gas to the preheating exchanger to heat it there;
- there is a steam feed pipe connected to the water pipe upstream of the heat exchanger for increasing the temperature of the water, either by direct injection into the water, or by indirect exchange with the water;
- an air separation device comprising a compressed air feed pipe, a purification unit and a cold box, containing a distillation column system, a pipe for producing a gas rich in nitrogen connecting the cold box and the purification unit and the heat exchanger is connected to the production pipe so that the gas rich in nitrogen is heated upstream of the purification unit;
- the air separation device comprises a compressed air feed pipe, a purification unit, a cold box, containing a distillation column system, the preheating exchanger being connected to the compressed air feed pipe and/or an air gas pipe coming from the cold box in order to heat water intended for the boiler and where applicable to the de-aerator;
- the device comprises means for sending water preheated in the preheating exchanger to the de-aerator and means for sending the preheated and de-aerated water from the de-aerator to the boiler.

According to another feature of the invention there is provided an integrated method for separation of air and heating of an air gas produced by separation of air in which air is separated in an air separation device, a gas enriched with oxygen is sent from the air separation device to a boiler, an air gas coming from the air separation device is heated by indirect exchange of heat with water, in liquid form preheated or to be preheated taken from downstream of a water preheating exchanger and/or with water in liquid form de-aerated or to be de-aerated from an water de-aerator, the preheating exchanger and/or the de-aerator treating water going to and coming from an oxycombustion boiler (19), the water used to preheat the air preferably being at a temperature between 100 and 200° C.

Where applicable:

- the water used to heat the air gas has been heated in the preheating exchanger and where applicable de-aerated in the de-aerator;
- the air going to the air separation device is compressed in a compressor and the air is cooled in the preheating exchanger by exchange of heat with water coming from the boiler;
- the air is compressed in a compressor, it is then purified in a purification unit and the purification unit is regenerated with nitrogen coming from the air separation device that has been heated by the water in the heat exchanger;
- all of the air compressed in the compressor is sent to the air separation device;

the water cooled in the heat exchanger is sent back to the preheating exchanger to preheat it therein;

the water sent to the heat exchanger is at a pressure between 5 and 20 bar absolute;

at least some of the water de-aerated in the de-aerator is sent directly to the boiler.

The thermal advantage of using a flow of water in liquid form BFW to heat the air gas is clearly apparent in FIG. 2 in the exchange diagram representing on the abscissa axis the exchange of heat E and on the ordinate axis the temperature T for heating residual nitrogen WN2, the ΔT being uniform and low throughout the heating process.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
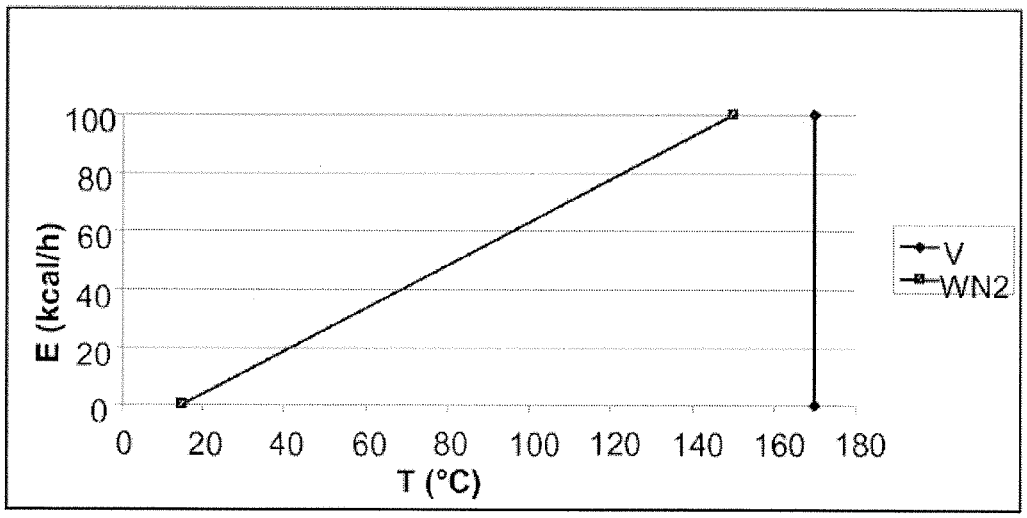
FIG. 1 represents an exchange diagram.
Figure 2:
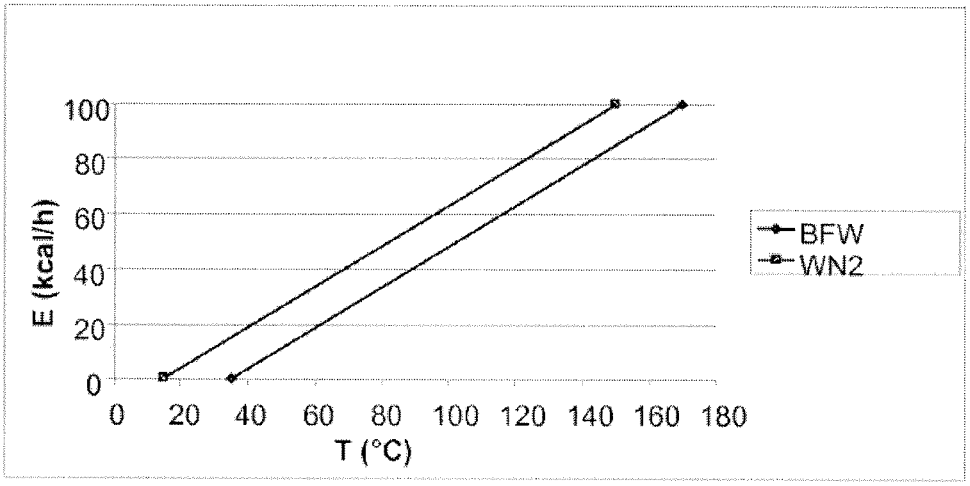
FIG. 2 represents an exchange diagram.
Figure 3:
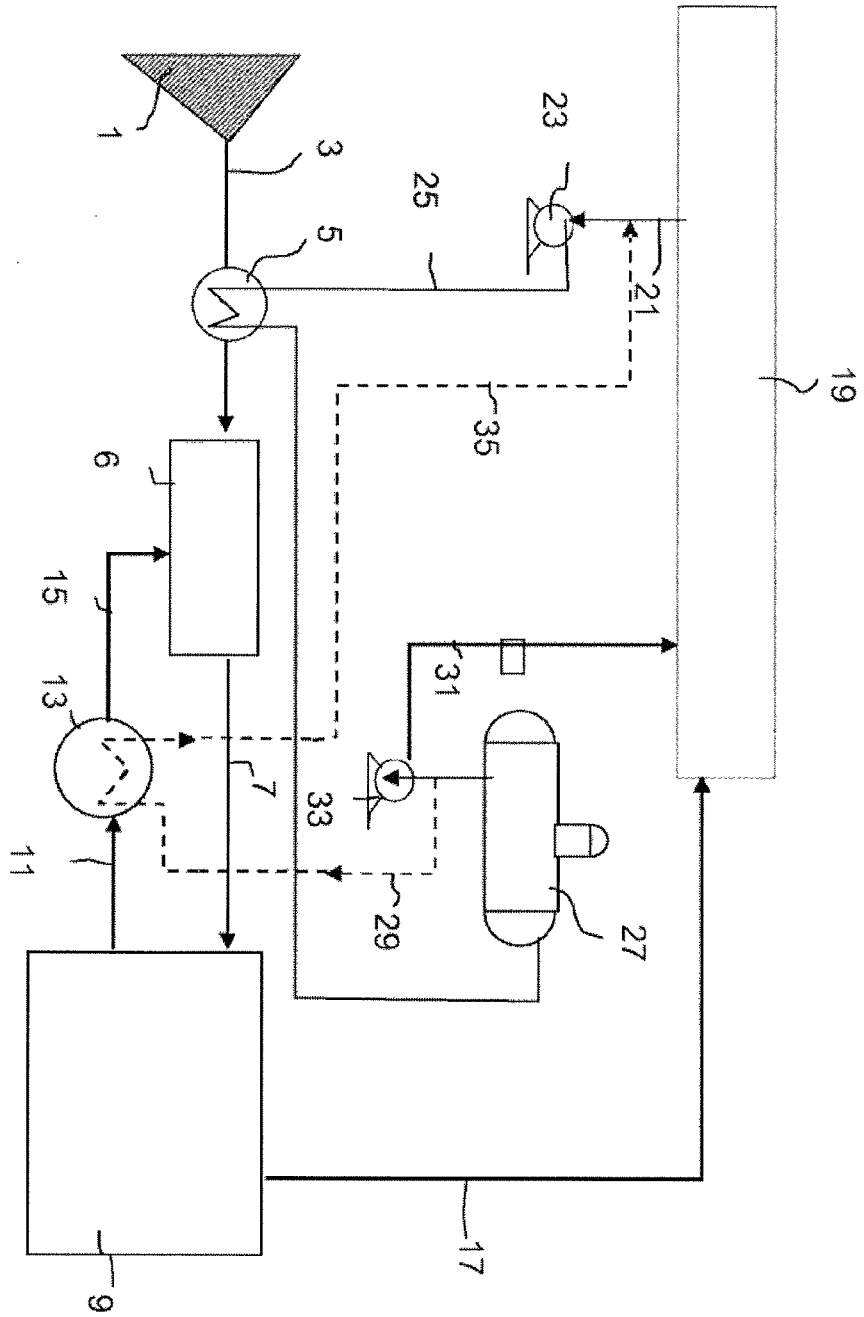
FIG. 3 represents a unit in accordance with an embodiment of the invention.
Figure 4:
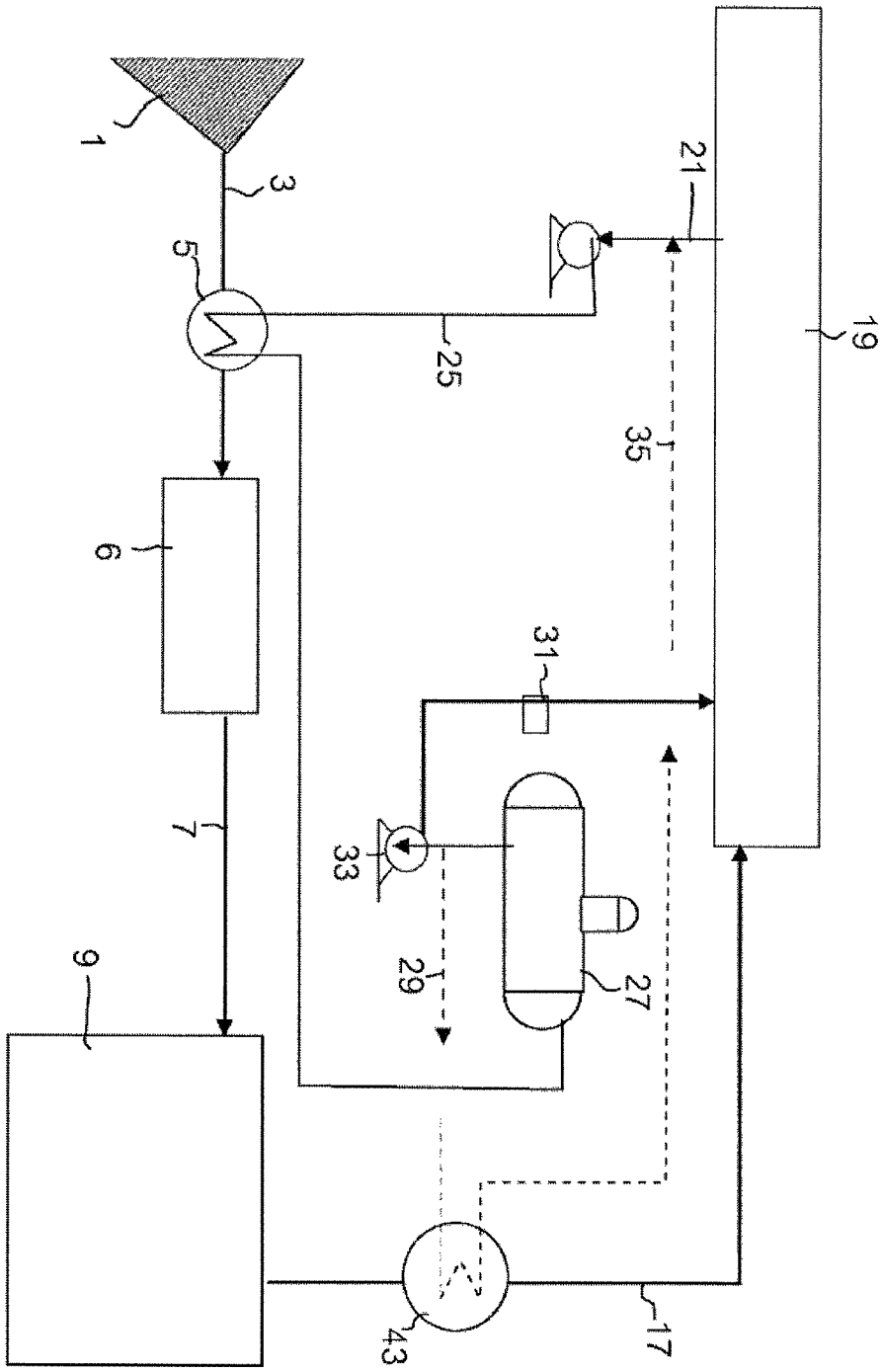
FIG. 4 represents a unit in accordance with an embodiment of the invention

Embodiments of the invention will be described in more detail with reference to the figures, FIGS. 3 and 4 representing heating devices according to the invention.

In FIG. 3 there is represented an air separation device comprising a compressor 1, an exchanger 5, a purification unit 6 and a cold box 9. All of the air 3 compressed in the compressor is cooled in the exchanger 5 by exchange of heat with water 25 in liquid form going to and coming from an oxycombustion boiler 19 fed with oxygen 17 and a fuel (not shown). The boiler produces flue gases (not shown) that are recycled or treated. The cooled air is purified in the purification unit 6 to form purified air 7 and is then separated in the cold box 9 containing an exchanger and a column system. From the cold box are produced a flow 17 rich in oxygen, which is sent to the oxycombustion boiler 19, and a gas flow 11 rich in nitrogen at room temperature, for example between 0 and 30° C. The nitrogen is heated in an indirect heat exchanger 13 by means of flow of hot water 29 in liquid form at a temperature between 100° C. and 200° C. The hot water 29 enters the exchanger 13 at between 100° C. and 200° C. and at a pressure between 5 bar and 20 bar absolute to be cooled to a temperature between 20° C. and 60° C. The heated nitrogen 15 is used to regenerate the purification unit 5.

The hot water 29 at between 100° C. and 200° C. comes in the situation shown from downstream of a water de-aerator 27. It is equally possible to take water from just upstream of the de-aerator, downstream of the exchanger 5 that is used to preheat the water (and possibly to inject steam into this water to increase its temperature to the required temperature) or upstream of this exchanger 5. The water that is not taken to heat the nitrogen is pumped in a high-pressure pump 33 and sent to the boiler. The water 21 leaving the boiler 19 at between 25° C. and 60° C. is pumped at a low pressure by the pump 23 to be sent to the preheater 5. The water that has been used to heat the nitrogen is sent back upstream of the pump 23 as a flow 35.

In FIG. 4 there is represented an air separation device comprising a compressor 1, an exchanger 5, a purification unit 6 and a cold box 9. All of the air 3 compressed in the compressor is cooled in the exchanger 5 by exchange of heat with water 25 in liquid form going to and coming from an oxycombustion boiler 19. The cooled air is purified in the purification unit 6 to form purified air 7 and is then separated in the cold box 9 containing an exchanger and a column system. From the cold box are produced a flow 17 rich in oxygen, which is sent to the oxycombustion boiler 19, and a gas flow rich in nitrogen at room temperature (not shown). The flow 17 at between 0° C. and 30° C. is heated a flow of hot water 29 in the exchanger 43 to heat the oxygen to between 100° C. and 200° C. and to cool the water to between 10° C. and 30° C. The hot water 29 at between 100° C. and 200° C. and at a pressure between 5 bar and 20 bar comes in the situation shown from a water de-aerator 27. It is equally possible to take water just upstream of the de-aerator, which is also downstream of the exchanger 5 that is used to preheat the water or upstream of that exchanger 5. The water that is not taken to heat the oxygen is pumped in a high-pressure pump 33 and sent to the boiler. The water 21 leaving the boiler 19 at between 25° C. and 60° C. is pumped at a low pressure by the pump 23 to be sent to the preheater 5. The water that has been used to heat the oxygen is sent back upstream of the pump 23 as a flow 35.

In one embodiment, the device of the invention includes no gas turbine and all of the air from the compressor of the air separation device is sent for separation.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a non-exclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. An integrated method for separation of air and heating of an air gas produced by separation of air, the method comprising the steps of:

compressing air in a compressor:

cooling the air in a water preheating exchanger:

feeding the air to an air separation device under conditions effective to separate the air in the air separation device to produce at least an oxygen enriched gas and a nitrogen enriched gas;

introducing the oxygen enriched gas from the air separation device to an oxycombustion boiler; and heating either the nitrogen enriched gas or the oxygen enriched gas coming from the air separation device by indirect exchange of heat with liquid water in an air gas heat exchanger, wherein the air gas heat exchanger is in fluid communication with a hot water source selected from the group consisting of the water preheating exchanger, a water de-aerator, and combinations thereof, wherein the water preheating exchanger and the water de-aerator are in fluid communication with the oxycombustion boiler, such that the oxycombustion boiler is configured to receive a hot water stream originating from the deaerator and the water preheating exchanger is configured to receive a cold water stream originating from the oxycombustion boiler.

2. The method as claimed in claim 1, wherein the liquid water used to heat either the oxygen enriched gas or the nitrogen enriched gas has been heated in the water preheating exchanger or de-aerated in the de-aerator.

3. The method as claimed in claim 1, further comprising the step of purifying the air in an air purifier before feeding the air to the air separation device.

4. The method as claimed in claim 3, further comprising the step of regenerating the air purifier using the heated nitrogen enriched gas coming from the air gas heat exchanger.

5. The method as claimed in claim 1, wherein all of the air compressed in the compressor is sent to the air separation device.

6. The method as claimed in claim 1, wherein the water cooled in the air gas heat exchanger is sent back to the water preheating exchanger to preheat the water.

7. The method as claimed in claim 1, wherein the liquid water sent to the heat exchanger is at a pressure between 5 and 20 bar absolute.

8. An integrated device for separating air and heating an air gas resulting from said air separation, the integrated device comprising:

an air separation device configured to receive a pressurized air stream and separate the pressurized air stream into an oxygen stream and a nitrogen stream;

an oxycombustion boiler configured to receive the oxygen stream from the air separation device and a hot water stream, wherein the oxycombustion boiler produces a cooled water stream;

an air gas heat exchanger in fluid communication with the air separation unit, such that the air gas heat exchanger is an indirect heat exchanger and is configured to heat the air gas against liquid water, wherein the air gas is selected from the group consisting of nitrogen, oxygen, and combinations thereof;

a water pre-heating exchanger in fluid communication with a water outlet of the oxycombustion boiler, wherein the water pre-heating exchanger is configured to heat the cooled water stream from the water outlet of the oxycombustion boiler against the pressurized air stream to produce the hot water stream; and a water circuit comprising a water compressor, the water pre-heating exchanger, the air gas heat exchanger, and the water outlet of the oxycombustion boiler, wherein the water circuit is configured to:

receive the cooled water stream from the water outlet of the oxycombustion boiler and transfer the cooled water to the water compressor for compression of the cooled water stream, transfer the cooled water stream to the water pre-heating exchanger for indirect heat exchange against the pressurized air stream to form a hot water stream, transfer the hot water stream to the air gas heat exchanger for indirect heat exchange against the air gas stream to produce a cold water recycle stream, and transfer the cold water recycle stream to a point upstream the water compressor and downstream the water outlet of the oxycombustion boiler.

9. The integrated device as claimed in claim 8, wherein the water circuit further comprises a de-aerator in fluid communication with the air gas heat exchanger, the water pre-heating exchanger, and a water inlet of the oxycombustion boiler, wherein the de-aerator is configured to receive at least a portion of the hot water stream and remove dissolved gas within the hot water stream.

10. The integrated device as claimed in claim 9, wherein the air gas heat exchanger is configured to receive the hot water stream from the deaerator.

11. The integrated device as claimed in claim 8, wherein the air gas heated in the air gas heat exchanger is oxygen.

12. The integrated device as claimed in claim 8, wherein the cooled water stream, the hot water stream, and the cold water recycle stream are all in liquid form.

13. An integrated method for separation of air and heating of an air gas produced by separation of air, the method comprising the steps of:

compressing air in a compressor;

cooling the air in a water preheating exchanger;

feeding the air to an air separation device under conditions effective to separate the air in the air separation device to produce at least an oxygen enriched gas and a nitrogen enriched gas;

introducing the oxygen enriched gas from the air separation device to an oxycombustion boiler; and heating the oxygen enriched gas coming from the air separation device by indirect exchange of heat with a hot water stream in an air gas heat exchanger, wherein the air gas heat exchanger is in fluid communication with a hot water outlet of a water de-aerator, wherein an inlet of the water preheating exchanger and the hot water outlet of the water de-aerator are in fluid communication with the oxycombustion boiler, such that the oxycombustion boiler is configured to receive a hot water stream originating from the deaerator, the water preheating exchanger is configured to receive a cold water stream originating from the oxycombustion boiler, and the air gas heat exchanger is configured to receive the hot water stream originating from the deaerator.

14. The integrated device as claimed in claim 13, wherein the hot water stream from the deaerator is in liquid form.

* * * * *